US007539452B2

(12) United States Patent
Sato et al.

(10) Patent No.: US 7,539,452 B2
(45) Date of Patent: May 26, 2009

(54) WASTE TONER COLLECTING APPARATUS, IMAGE FORMING APPARATUS AND PROCESS CARTRIDGE OF IMAGE FORMING APPARATUS

(75) Inventors: Tsutomu Sato, Izunokuni (JP); Masayuki Kasukawa, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 95 days.

(21) Appl. No.: 11/676,553

(22) Filed: Feb. 20, 2007

(65) Prior Publication Data

US 2007/0196149 A1 Aug. 23, 2007

(30) Foreign Application Priority Data

Feb. 20, 2006 (JP) ..... 2006-043114

(51) Int. Cl.
*G03G 21/12* (2006.01)
*G03G 15/08* (2006.01)

(52) U.S. Cl. ..... 399/360; 399/120

(58) Field of Classification Search ..... 399/101, 399/120, 123, 358, 360
See application file for complete search history.

(56) References Cited

U.S. PATENT DOCUMENTS

| | | | | |
|---|---|---|---|---|
| 4,849,791 | A * | 7/1989 | Hagihara et al. | 399/360 |
| 5,285,250 | A * | 2/1994 | Yoshioka | 399/120 |
| 5,634,186 | A * | 5/1997 | Villalobos-Garcia et al. | 399/360 |
| 5,933,690 | A * | 8/1999 | Sugimoto et al. | 399/358 X |
| 6,308,017 | B1 * | 10/2001 | Taniyama et al. | 399/358 X |
| 6,937,838 | B2 * | 8/2005 | Ishii et al. | 399/358 |
| 6,937,839 | B2 * | 8/2005 | Harumoto et al. | 399/360 |
| 6,975,830 | B2 * | 12/2005 | Murakami et al. | 399/358 |

FOREIGN PATENT DOCUMENTS

JP 2517201 8/1996

* cited by examiner

*Primary Examiner*—Sandra L Brase
(74) *Attorney, Agent, or Firm*—Amin, Turocy & Calvin, LLP

(57) ABSTRACT

A waste toner collecting apparatus of the present invention reliably prevents waste toner from spilling when replacing the waste toner box by opening the front cover of an image forming apparatus as the first through fifth shutters close the respective waste toner conveyance end sections. The first through fifth shutters are locked when no waste toner box is mounted in the image forming apparatus. The first through fifth shutters are unlocked when a waste toner box is mounted in the image forming apparatus. It can reliably prevent an operation error of operating the image forming section with the waste toner conveyance end sections left in an open state as the stay of the cover presses the first through fifth shutters when a waste toner box is not mounted.

14 Claims, 11 Drawing Sheets

WASTE TONER COLLECTING APPARATUS, IMAGE FORMING APPARATUS AND PROCESS CARTRIDGE OF IMAGE FORMING APPARATUS

CROSS-REFERENCE TO RELATED APPLICATION

This application is based upon and claims the benefit of priority from prior Japanese Patent Application No. 2006-43114 filed on Feb. 20, 2006, the entire contents of which are incorporated herein by reference.

BACKGROUND OF THE INVENTION

1. Field of the Invention

The present invention relates to a waste toner collecting apparatus for collecting waste toner used in an electronic photography type copying machine, a printer or the like adapted to produce a color image by laying toner images of a plurality of different colors one on the other. This invention also relates to an image forming apparatus and a process cartridge to be used in an image forming apparatus.

2. Description of the Related Art

A cleaning apparatus such as a blade is normally operated to remove toner remaining on a photosensitive member of an image forming apparatus such as a copying machine or a printer after the end of an image transfer process. The toner removed from the photosensitive member is collected in a waste toner box as waste toner. When the waste toner box becomes full, it is replaced by a new one.

Tandem type image forming apparatus have been marketed in recent years. A plurality of image forming units, each having a photosensitive member, are arranged in parallel in a tandem type image forming apparatus and the toner images of different colors formed on the respective photosensitive members are transferred onto a single sheet and laid one on the other to produce a color image. Apparatus have been developed for such a tandem type image forming apparatus to collect the residual toner produced from a plurality of photosensitive members and an intermediate transfer belt in a single waste toner box. When the waste toner box becomes full, it is replaced by a new one.

Among such apparatus, some are equipped with a device for preventing waste toner from spilling if a waste toner conveying section and the waste toner box are moved away from each other during the operation of replacing the waste toner box. For example, Jpn. U. M. Registration No. 2517201 discloses the use of shutters for preventing waste toner from spilling.

The known device interlocks the operation of opening/closing the shutters and that of mounting/dismounting a waste toner container. More specifically, two shutters are opened and closed with a time lag to prevent waster toner from spilling when the shutters are operated during the process of mounting or dismounting the waste toner container. Thus, the device is structurally complex and requires high manufacturing cost. Particularly, a number of shutters have to be installed at high cost when such a device is used for a tandem type image forming apparatus having a plurality of image forming units aligned.

Therefore, there is a demand for a waste toner collecting apparatus, an image forming apparatus and a process cartridge of image forming apparatus, to be used for an image forming apparatus including a replaceable waste toner box, which is structurally simple, can reliably prevent waste toner from spilling when replacing the waste toner box and also can prevent the operation errors when replacing the waste toner box. As a result, it is obtaining the safety and the reduction of cost.

SUMMARY OF THE INVENTION

An aspect of the present invention is to provide a waste toner collecting apparatus, an image forming apparatus and a process cartridge of image forming apparatus, which is structurally simple, which can reliably prevent waste toner from spilling and also can prevent operation errors when replacing the waste toner box, and so obtaining the safety and the reduction of cost.

According to an embodiment of the present invention, there is provided a waste toner collecting apparatus comprising: a waste toner containing member to be replaceable mounted in a main body of an image forming apparatus and through into a conveyance section for conveying waste toner collected from an image forming section in order to contain the waste toner; a shutter adapted to slide in a motion interlocked with an opening/closing motion of a cover of the main body of the image forming apparatus in order to open a conveyance end section of the conveyance section at the time of closing the cover but close the conveyance end section of the conveyance section at the time of opening the cover; and a lock member adapted to contact the waste toner containing member mounted in the main body of the image forming apparatus in order to open a moving route of the shutter at the time of sliding the shutter to open it but move away from the waste toner containing member in order to block the moving route of the shutter at the time of sliding the shutter to open it.

DETAILED DESCRIPTION OF THE INVENTION

Figure 1:
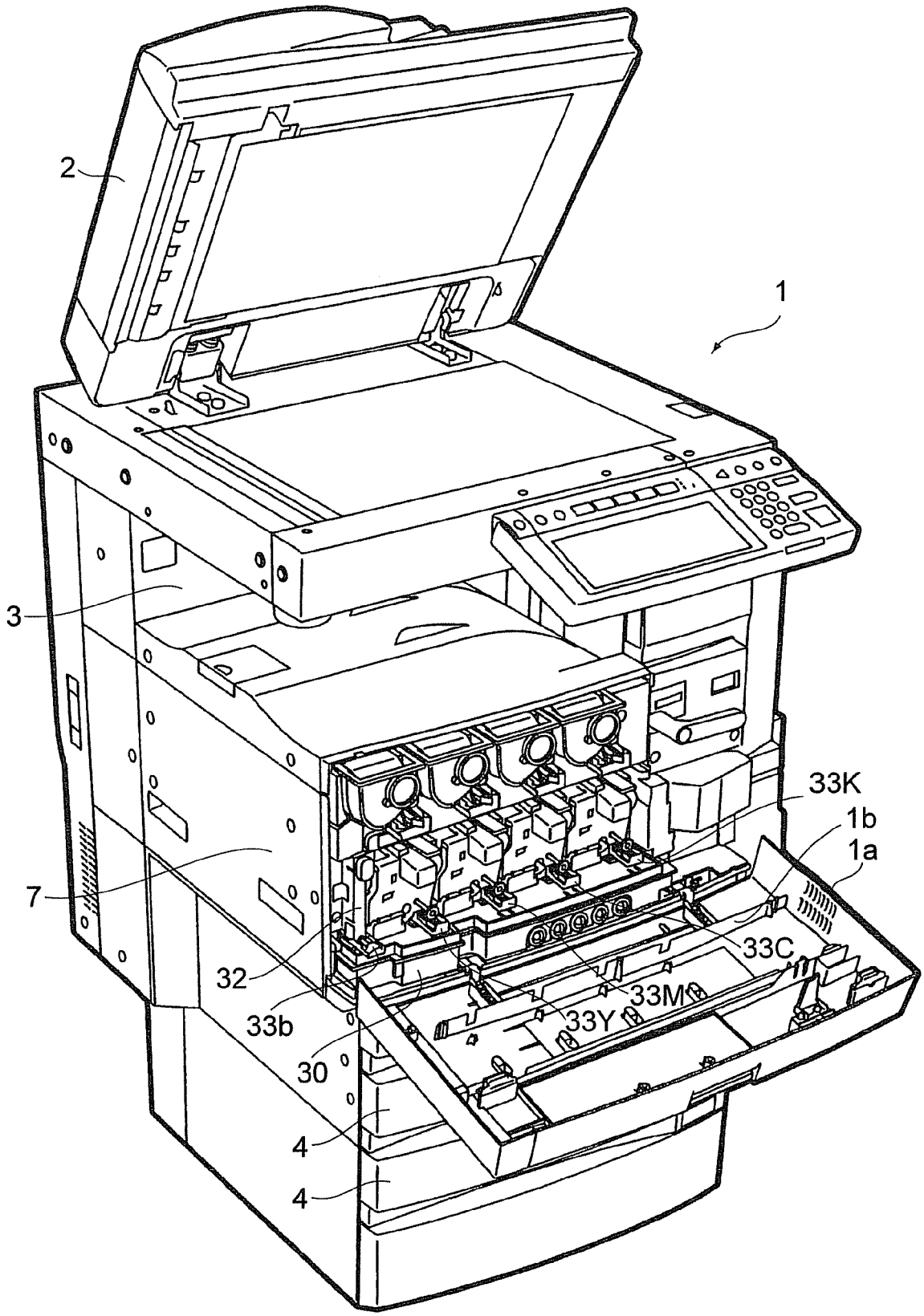
FIG. 1 is a schematic perspective view according to an embodiment of the present invention, which is a color copying machine, showing the appearance thereof when its front cover is opened.
Figure 2:
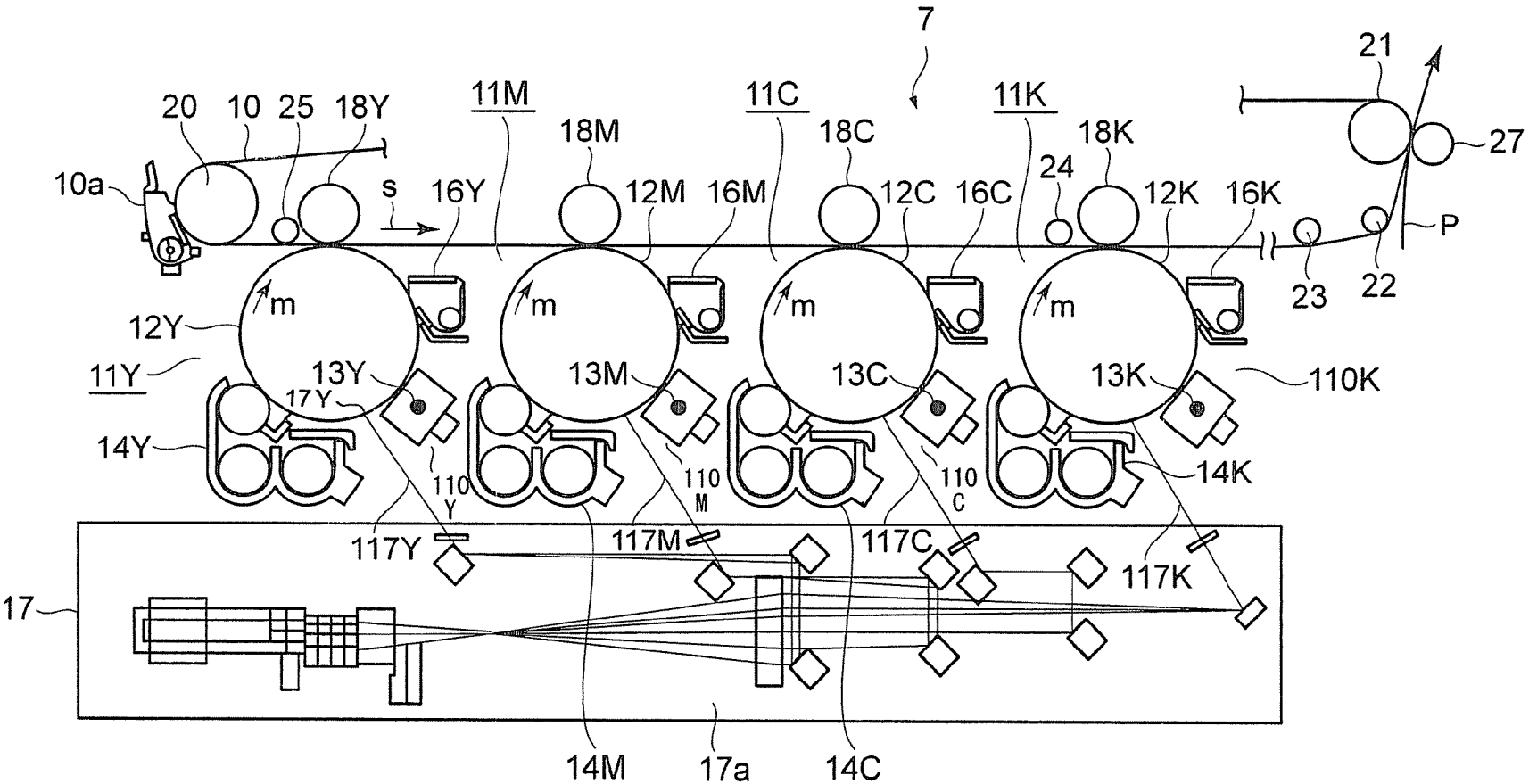
FIG. 2 is a schematic illustration of a configuration of an image forming section according to the embodiment of the present invention.

Now, a preferred embodiment of the present invention will be described in greater detail by referring to the accompanying drawings. FIG. 1 is a schematic perspective view according to an embodiment of the present invention, which is a 4-unit tandem type color copying machine 1, showing the appearance thereof when its front cover 1*a* is opened. FIG. 2 is a schematic illustration of an image forming section 7 of the color copying machine 1, showing the configuration thereof. The color copying machine 1 comprises a scanner section 2 and an inter-body sheet eject section 3 arranged in an upper part thereof. The color copying machine 1 further comprises four image forming units 11Y, 11M, 11C and 11K arranged in parallel below an intermediate transfer belt 10, which is a transfer medium, for yellow (Y), magenta (M), cyan (C) and black (K) images respectively.

The image forming units 11Y, 11M, 11C and 11K respectively have photosensitive drums 12Y, 12M, 12C and 12K as an image carrier. Electric chargers 13Y, 13M, 13C and 13K, development apparatus 14Y, 14M, 14C and 14K and photosensitive member cleaning apparatus 16Y, 16M, 16C and 16K, which are cleaning members, are arranged respectively around the photosensitive drums 12Y, 12M, 12C and 12K in the mentioned order in the direction of rotation thereof as indicated by arrows m. Laser beams 117Y, 117M, 117C, and 117K are irradiated respectively onto the surfaces of the photosensitive drums 12Y, 12M, 12C and 12K from a laser exposure apparatus 17 in the spans from the electric chargers 13Y, 13M, 13C and 13K to the development apparatus 14Y, 14M, 14C and 14K.

In the image forming unit 11Y for yellow (Y), for example, the photosensitive drum 12Y and the electric charger 13Y, the development apparatus 14Y and the photosensitive member cleaning apparatus 16Y around the drum 12Y are arranged in a process cartridge 110Y. The process cartridge 110Y is integrally and removably mounted in the color copying machine 1. Note, however, the configuration of the process cartridge is not limited to the above-described one so long as it is adapted to integrally support a photosensitive member cleaning apparatus 16Y and a photosensitive drum 12Y and removably mounted in the color copying machine 1. Similar process cartridges 110M, 110C and 110K are provided respectively for the image forming units 11M, 11C and 11K for magenta (M), cyan (C) and black (K).

The electric chargers 13Y, 13M, 13C and 13K uniformly charge the surfaces of the respective photosensitive drums 12Y, 12M, 12C and 12K with electricity to about −700V, for example. The development apparatus 14Y, 14M, 14C and 14K supply the photosensitive drums 12Y, 12M, 12C and 12K with 2-ingredient development agents containing respectively yellow (Y), magenta (M), cyan (C) and black (K) toners and carrier.

The laser exposure apparatus 17 scans the photosensitive drums 12Y, 12M, 12C and 12K in the respective axial directions by means of the laser beams emitted from a semiconductor laser element to from images on the photosensitive drums 12Y, 12M, 12C and 12K by way of a focusing lens system 17*a*.

The intermediate transfer belt 10 is made of a stable material in terms of heat resistance and abrasion resistance, which may typically be a semiconductor polyimide. The intermediate transfer belt 10 is wound around a drive roller 21, a follower roller 20 and first through fourth tension rollers 22-25 and held at tension. A primary transfer voltage is applied to the intermediate transfer belt 10 at the primary transfer positions thereof where it faces the photosensitive drums 12Y, 12M, 12C and 12K by means of respective primary transfer rollers 18Y, 18M, 18C and 18K so that the toner images on the photosensitive drums 12Y, 12M, 12C and 12K are transferred onto the intermediate transfer belt 10 in a primary transfer operation. After the completion of the primary transfer operation, the photosensitive member cleaning apparatus 16Y, 16M, 16C and 16K respectively collect the residual toners on the photosensitive drums 12Y, 12M, 12C and 12K as waste toner.

A secondary transfer roller 27 is arranged vis-à-vis the intermediate transfer belt 10 at the secondary transfer position where it is supported by the drive roller 21. A secondary transfer voltage is applied at the secondary transfer position to the toner image on the intermediate transfer belt 10 by means of the second transfer roller 27 and by way of a sheet of paper P supplied from a sheet feeding section 4, for example. As a result, the toner image on the intermediate transfer belt 10 is transferred onto the sheet of paper P in a secondary transfer operation. A belt cleaner 10*a* is arranged at a downstream position of the intermediate transfer belt 10 relative to the secondary transfer roller 27. The belt cleaner 10*a* collects the toner remaining on the intermediate transfer belt 10 after the completion of the secondary transfer operation as waste toner.

A waste toner box 30, which is a waste toner containing member, is removably fitted to the front side of the image forming section 7 of the color copying machine 1 at a position below the image forming units 11Y, 11M, 11C and 11K, or at the front side of the laser exposure apparatus 17. The waste toner box 30 is an elongate shape arranged along the direction of arrangement of the image forming units 11Y, 11M, 11C and 11K. The waste toner box 30 contains the waste toner collected by the photosensitive member cleaning apparatus 16Y, 16M, 16C and 16K of the image forming units 11Y, 11M, 11C and 11K. The waste toner box 30 also contains the waste toner collected by the belt cleaner 10*a*. When a photo-sensor 38 arranged above the waste toner box 30 detects that the latter is full, it is replaced by a new one.

Figure 3:
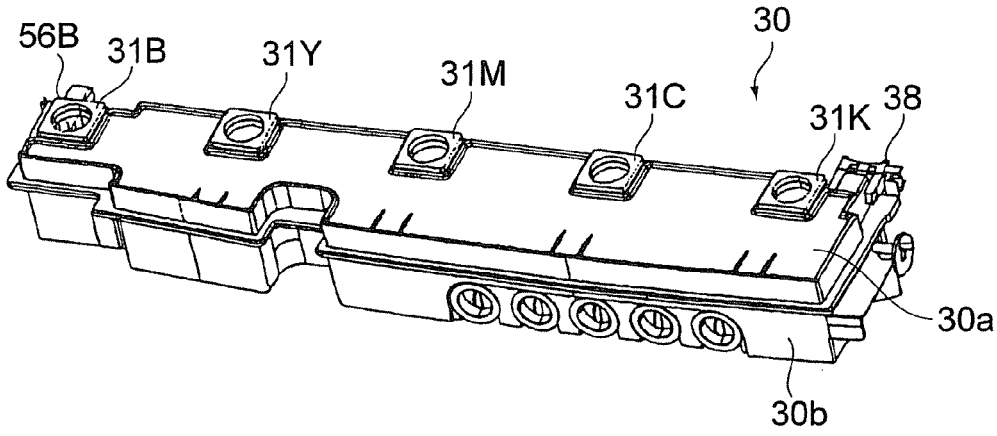
FIG. 3 is a schematic perspective view of a waste toner box according to the embodiment of the present invention.
Figure 4:
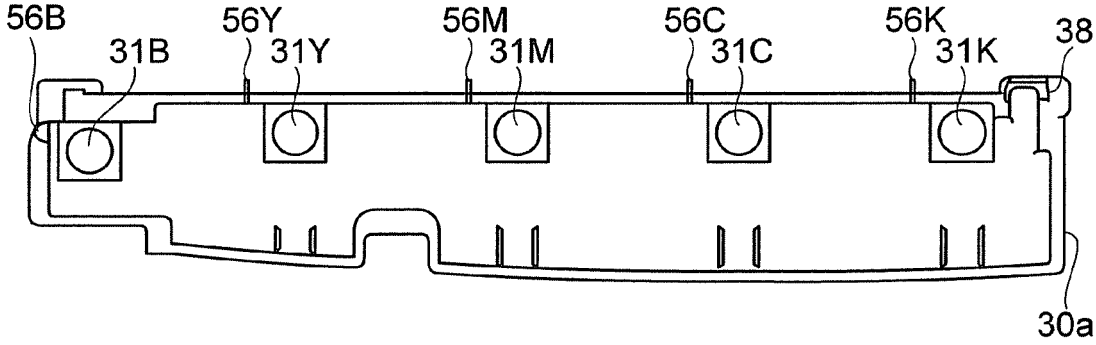
FIG. 4 is a schematic plan view of the waste toner box according to the embodiment of the present invention.

As shown in FIGS. 3 and 4, the waste toner box 30 includes a main body section 30*b* and a closure section 30*a* that covers the top surface of the main body section 30*b*. First through fifth collecting ports 31B, 31Y, 31M, 31C and 31K are formed through the closure section 30*a* for the purpose of collecting waste toner. The first collecting port 31B is for collecting waste toner brought in from the belt cleaner 10*a*. The second through fifth collecting ports 31Y, 31M, 31C and 31K are for collecting the waste toners brought in respectively from the photosensitive member cleaning apparatus 16Y, 16M, 16C and 16K. Additionally, the closure section 30*a* is provided at the rear side thereof with first through fifth projections 56B, 56Y, 56M, 56C and 56K that are unlocking members for turning respectively a belt-side stopper 54 that is a later-described lock member and second through fifth drum-side stoppers 62.

Figure 5:
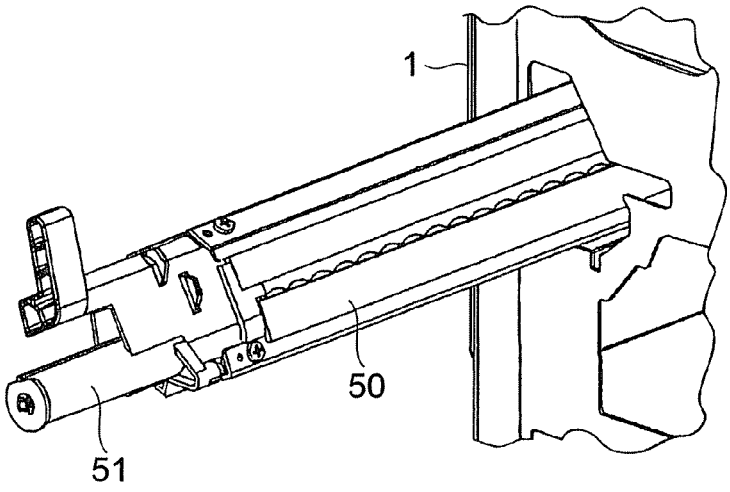
FIG. 5 is a schematic perspective view of part of a belt cleaner according to the embodiment of the present invention.
Figure 6:
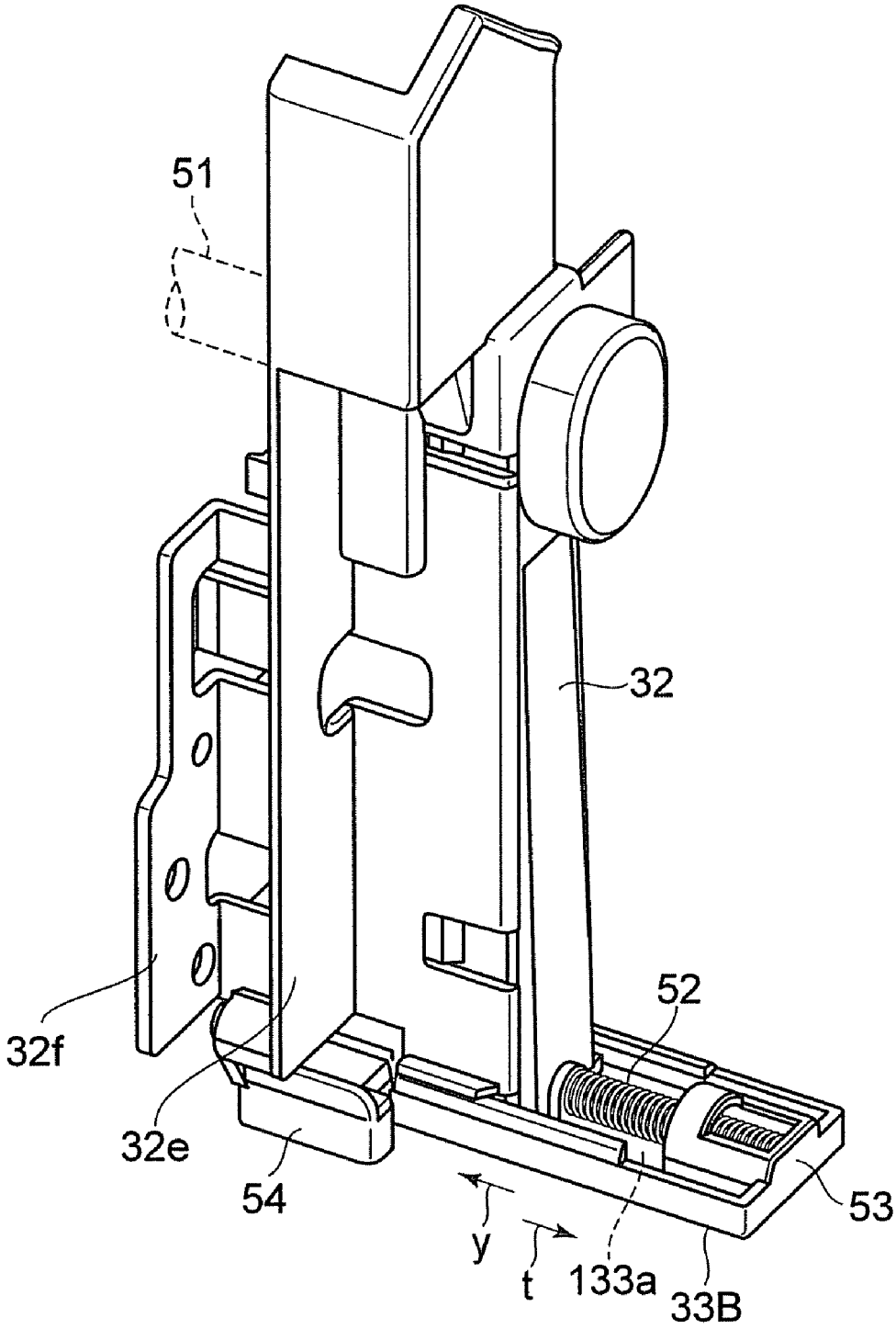
FIG. 6 is a schematic perspective view of a shutter according to the embodiment of the present invention when it closes a conveyance section and a conveyance end section thereof.
Figure 7:
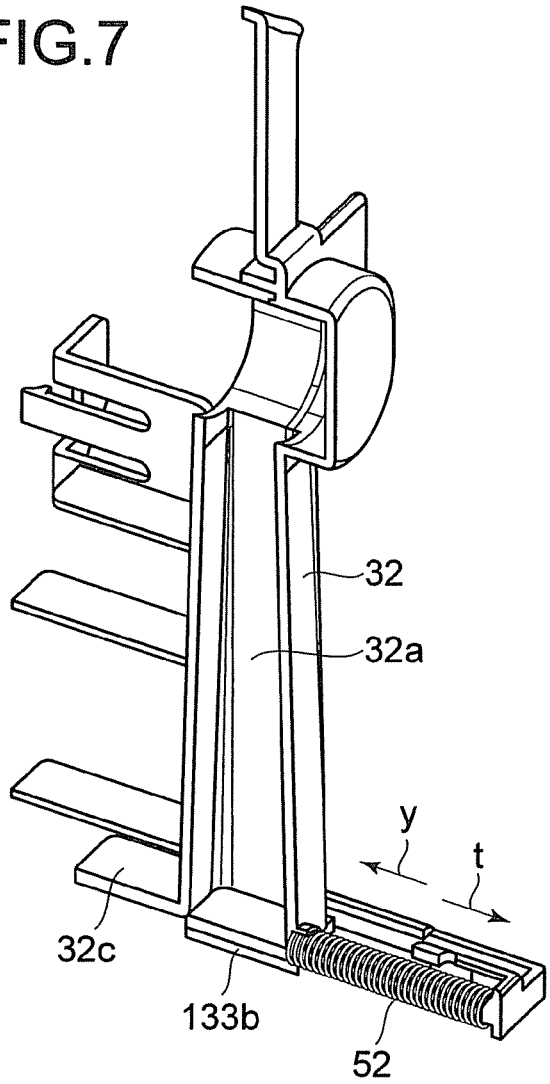
FIG. 7 is a schematic perspective view of partially cut out the shutter according to the embodiment of the present invention when it closes the conveyance section and the conveyance end section thereof.

As shown in FIG. 5, the belt cleaner 10*a* conveys the waste toner collected by the cleaning blade 50 to the front side by means of an auger 51. The waste toner that is conveyed to the front side is made to fall and flow into the waste toner box 30 by way of a duct 32*a* of a conveyance section 32 that is connected to the front end of the auger 51 as shown in FIGS. 6 and 7.

The photosensitive member cleaning apparatus 16Y, 16M, 16C and 16K also convey the waste toners collected by the cleaning blades (not shown) to the front side by way of augers (not shown) to make them fall and flow into the waste toner box 30 via drum-side conveyance sections 57 connected to the front ends of the augers respectively.

Figure 8:
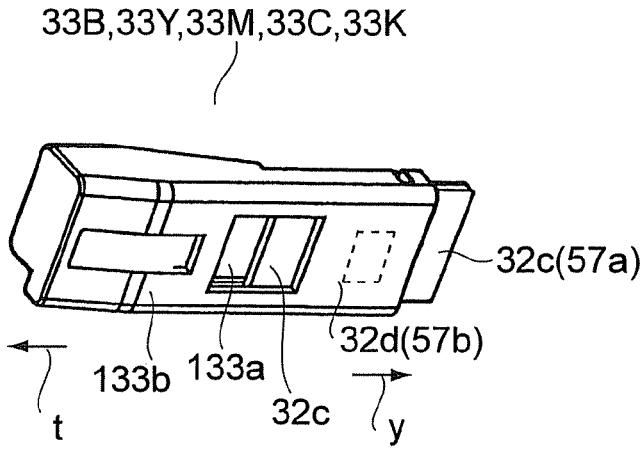
FIG. 8 is a schematic perspective view of the shutter according to the embodiment of the present invention as viewed from the side of the waste toner box.

A conveyance end section 32*d* of the waste toner conveyance section 32 of the belt cleaner 10*a* and conveyance end sections 57*b* of the drum-side conveyance sections 57 of the photosensitive member cleaning apparatus 16Y, 16M, 16C and 16K are provided respectively with first through fifth shutters 33B, 33Y, 33M, 33C and 33K. When viewed from the rear side, each of the first through fifth shutters 33B, 33Y, 33M, 33C and 33K has a window section 133*a* and shield section 133*b* as shown in FIG. 8.

The window sections 133*a* of the first through fifth shutters 33B, 33Y, 33M, 33C and 33K are located respectively in front of the conveyance end section 32*d* of the conveyance section 32 and the conveyance end sections 57*b* of the drum-side conveyance sections 57 when the front ends 53 thereof are pressed by a stay 1*b* arranged on the front cover 1*a*. Then, as a result, the conveyance end section 32*d* and the drum-side conveyance end sections 57*b* are held open. On the other hand, the first through fifth shutters 33B, 33Y, 33M, 33C and 33K are located respectively in front of the conveyance end sections 32*d* of the conveyance section 32 and the conveyance end sections 57*b* of the drum-side conveyance sections 57 when the front ends 53 thereof are moved away from the stay 1*b*. Then, as a result, the conveyance end section 32*d* and the drum-side conveyance end sections 57*b* are closed.

When the first through fifth shutters 33B, 33Y, 33M, 33C and 33K are opened, the conveyance section 32 and the drum-side conveyance sections 57 are respectively through into the first through fifth collecting ports 31B, 31Y, 31M, 31C and 31K of the waste toner box 30.

Figure 9:
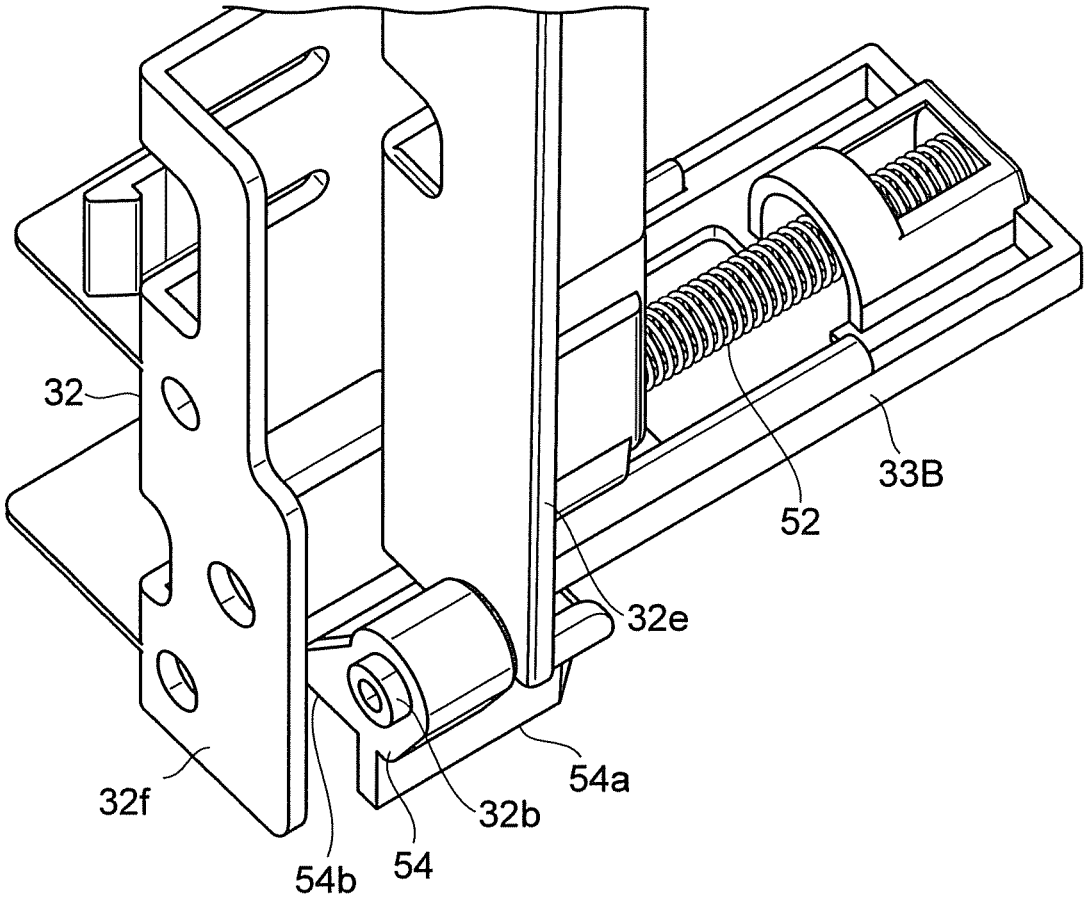
FIG. 9 is a schematic perspective view of the shutter according to the embodiment of the present invention as viewed from the rear side of the conveyance section.

The first shutter 33B can slide along a guide 32*c* formed on the conveyance section 32. Additionally, the first shutter 33B is urged toward the front side by the resiliency of a spring 52. As shown in FIG. 9, a belt-side stopper 54 is fitted to the rear side of the conveyance section 32 as a lock member for opening and closing the sliding route of the shutter 33B. The belt-side stopper 54 is fitted to the shaft 32*b* projecting from the stay 32*e* of the conveyance section 32 so as to be able to turn by its own weight.

Figure 10:
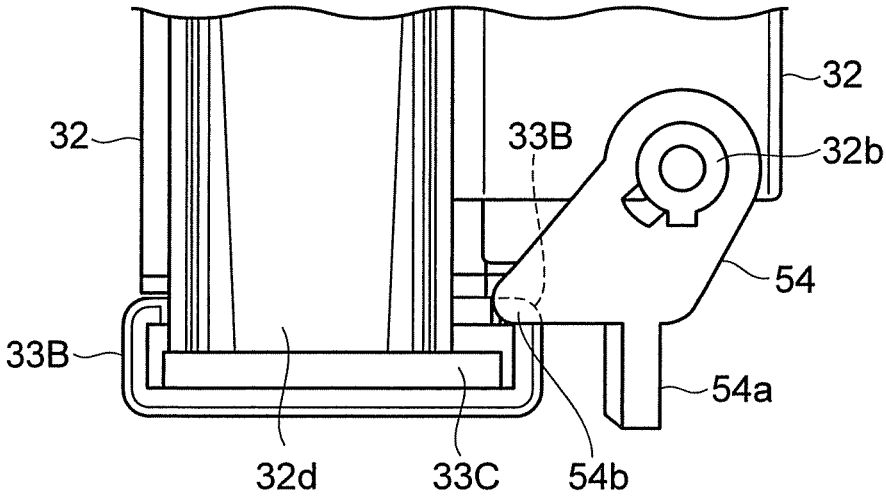
FIG. 10 is a schematic lateral view of a belt-side stopper according to the embodiment of the present invention in the locked sate as viewed from the rear side of the conveyance section.

When the belt-side stopper 54 is free to turn, a projecting cam 54*a* hangs down substantially vertically by its own weight as shown in FIG. 10. In this condition, an actuating section 54*b* of the belt-side stopper 54 is located on the sliding route of the shutter 33B to interference with the upper end part of the shutter 33B indicated by dotted line in FIG. 10 and lock the shutter 33B so that it may not slide to move. When the waste toner box 30 is mounted in the main body of the color image forming apparatus 1, the belt-side stopper 54 contacts the first projection 56B formed at the rear side of the waste toner box 30 so as to be forced to turn in the direction of arrow u in FIG. 11. In this condition, the actuating section 54*b* of the belt-side stopper 54 is located above the sliding route of the shutter 33B to unlock the latter and allow it to slide.

Note, however, the structure of the conveyance section 32 is not limited to the above-described one. For example, a column for reinforcing the stay 32*e* may be arranged between the stay 32*e* and a support board 32*f* in order to prevent the actuating section 54*b* of the stopper 54 from moving away from the position where it interferes with the shutter 33B by the deflection of the stay 32*e*.

The second through fifth shutters 33Y, 33M, 33C and 33K, which show the same and identical profile, can slide respectively along the guides 57*a* that are formed on the drum-side conveyance sections 57 for conveying the waste toners of the photosensitive member cleaning apparatus 16Y, 16M, 16C and 16K. Like the first shutter 33B, the second through fifth shutters 33Y, 33M, 33C and 33K are constantly urged toward the front side by the resiliency of respective springs 58*a*. Thus, the first through fifth shutters 33B, 33Y, 33M, 33C and 33K slide toward the front side due to the spring 52 and the springs 58*a* once the pressure exerted by the stay 1*b* of the front cover 1*a* is released.

Figure 12:
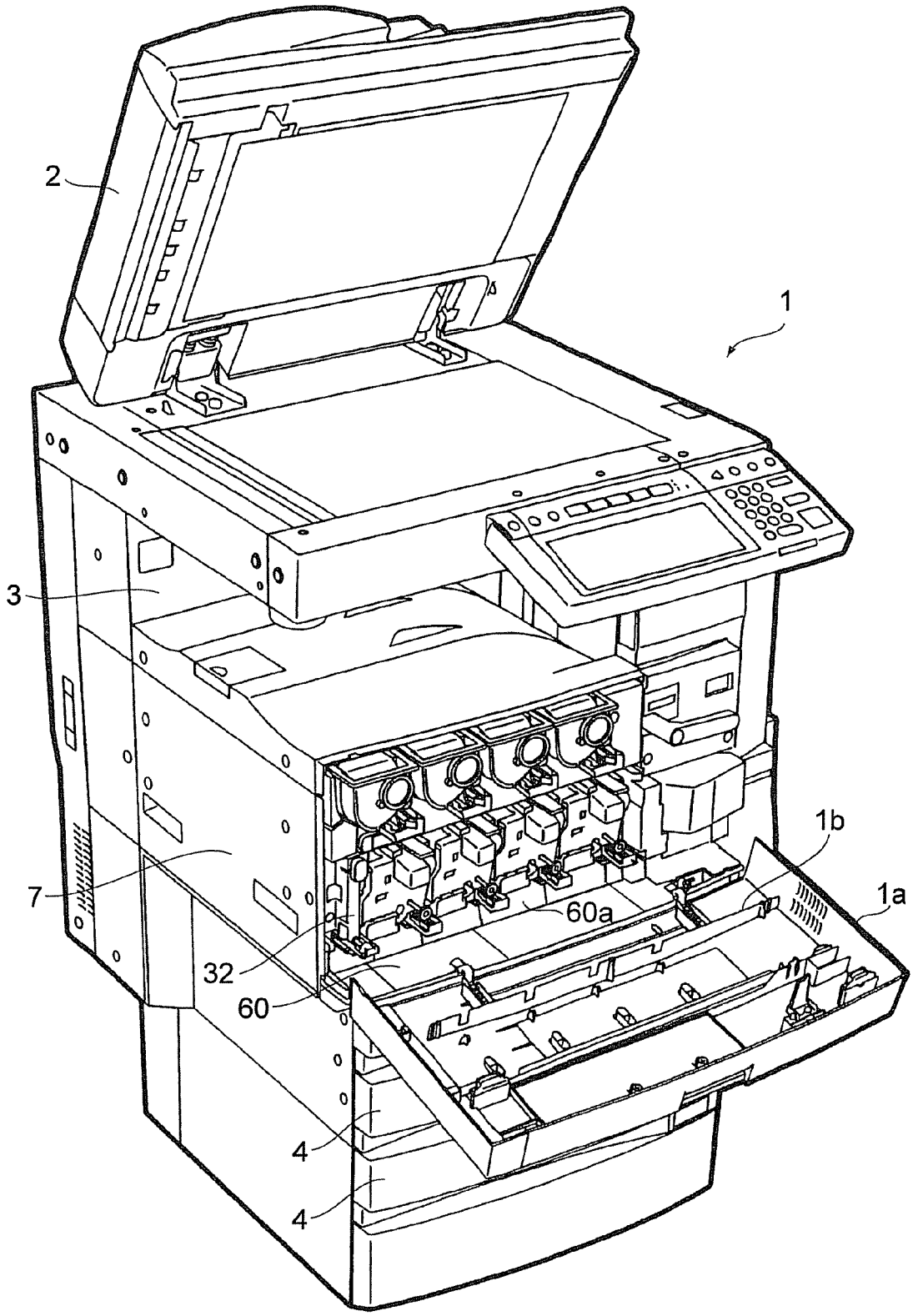
FIG. 12 is a schematic perspective view according to the embodiment of the present invention, which is a color copying machine, showing the appearance thereof when the front cover is opened and the waste toner box is removed.
Figure 13:
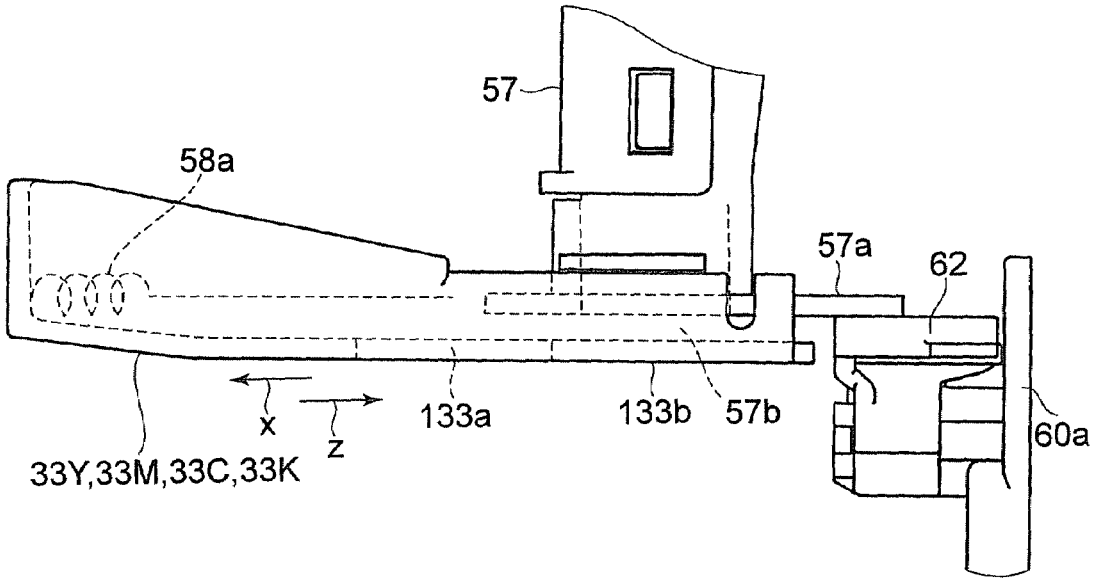
FIG. 13 is a schematic lateral view of one of the drum-side shutters and the corresponding one of the drum-side stoppers according to the embodiment of the present invention, where the drum-side stopper is in the locked state.
Figure 14:
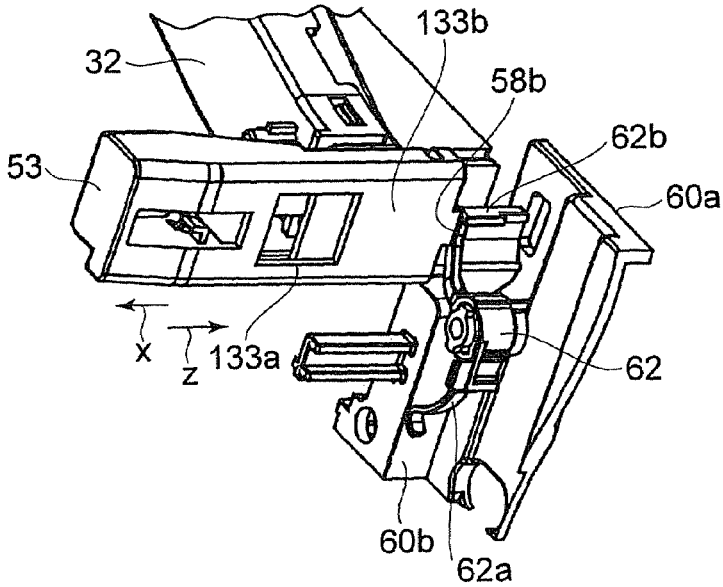
FIG. 14 is a schematic perspective view of one of the drum-side shutters and the corresponding one of the drum-side stoppers according to the embodiment of the present invention as viewed from the side of the waste toner box, where the drum-side stopper is in the locked state.
Figure 15:
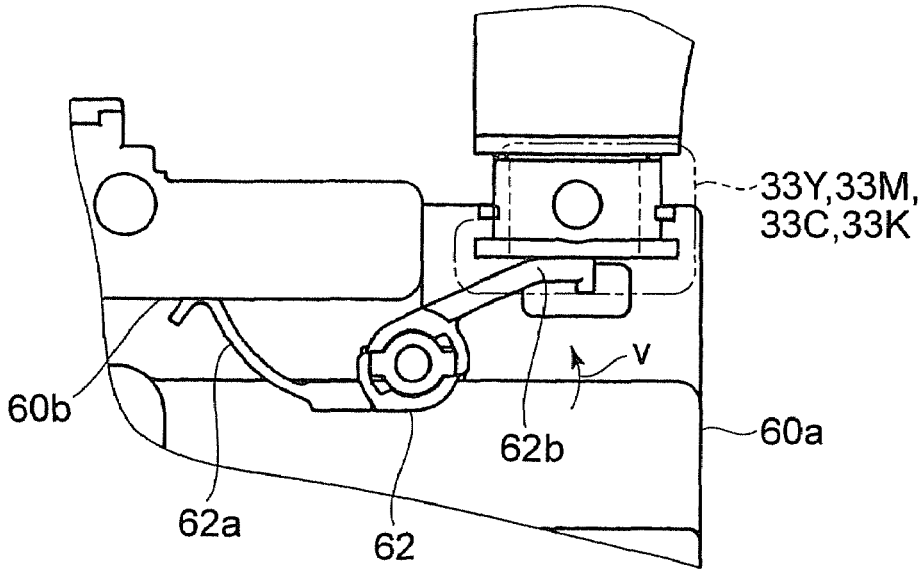
FIG. 15 is a schematic front view of part of the drum-side shutters and the drum-side stoppers according to the embodiment of the present invention, where the drum-side stopper is in the locked state.

As shown in FIGS. 12 and 14, the drum-side stoppers 62 are fitted to a rear frame 60*a* of a frame 60 that supports the waste toner box 30 in the color copying machine 1 so as to operate as lock members for opening and closing the sliding routes of the second through fifth shutters 33Y, 33M, 33C and 33K. As shown in FIGS. 13, 14 and 15, the front ends of the leaf spring sections 62*a* of the drum-side stoppers 62 are restricted by a block section 60*b* of the rear frame 60*a*. Thus, as a result, lever sections 62*b* of the drum-side stoppers 62 are urged in the direction of arrow v in FIG. 15.

When the drum-side stoppers 62 are free, the lever sections 62*b* are turned respectively by the resiliency of the leaf spring sections 62*a* in the direction of arrow v so that the second through fifth shutters 33Y, 33M, 33C and 33K are located on the respective sliding routes as seen from FIG. 15. Then, as a result, the lever sections 62*b* interfere respectively with the ribs 58*b* formed at the rear sides of the second through fifth shutters 33Y, 33M, 33C and 33K at the positions indicated by doubly dotted chain lines in FIG. 15. Thus, the second through fifth shutters 33Y, 33M, 33C and 33K are locked and cannot slide to move.

Figure 16:
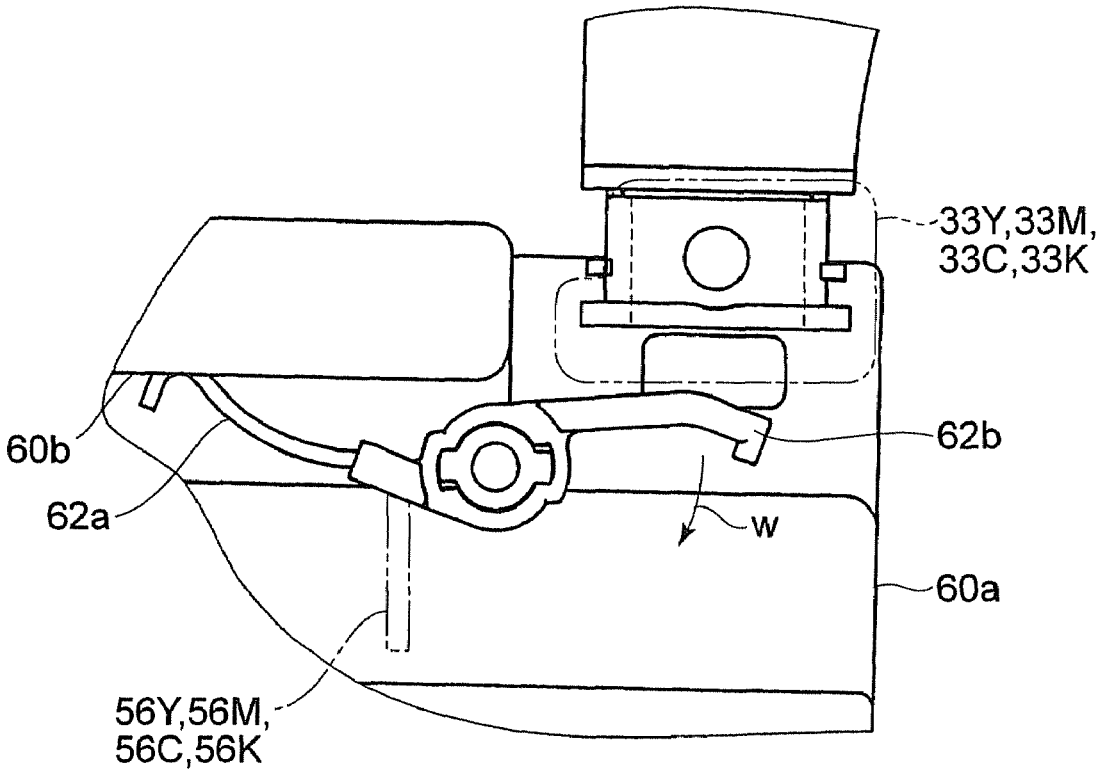
FIG. 16 is a schematic front view of the drum-side shutters and the drum-side stoppers according to the embodiment of the present invention, where the drum-side stopper is in the unlocked state.
Figure 17:
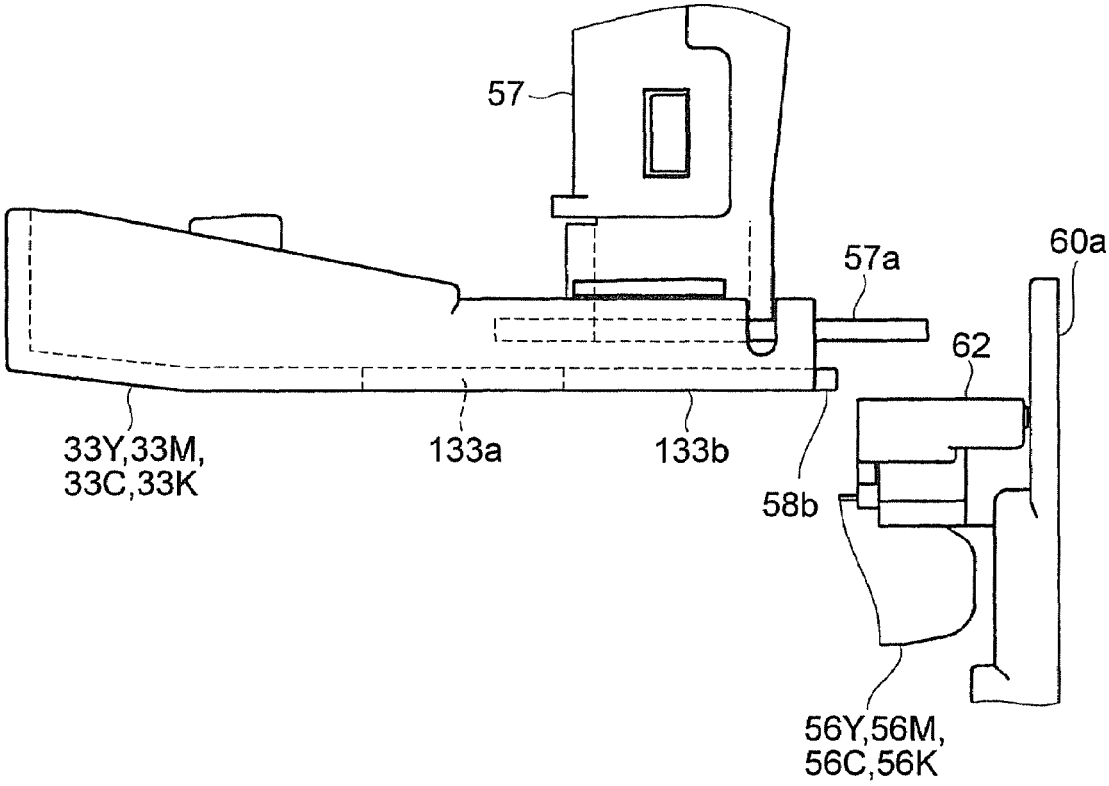
FIG. 17 is a schematic lateral view of the drum-side shutters and the drum-side stoppers according to the embodiment of the present invention, where the drum-side stopper is in the unlocked state.
Figure 18:
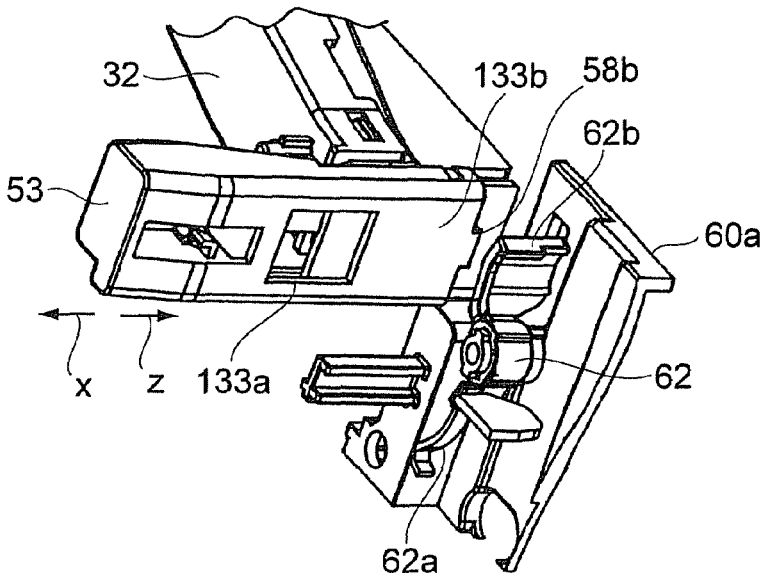
FIG. 18 is a schematic perspective view of the drum-side shutters and the drum-side stoppers according to the embodiment of the present invention as viewed from the side of the waste toner box, where the drum-side stopper is in the unlocked state.

When the waste toner box 30 is mounted in the main body of the color image forming apparatus 1, the second through fifth projections 56Y, 56M, 56C and 56K formed at the rear side of the waste toner box 30 respectively abut the leaf spring sections 62*a* of the drum-side stoppers 62 as shown in FIGS. 16, 17 and 18. As the second through fifth projections 56Y, 56M, 56C and 56K abut the respective leaf spring sections 62*a*, the latter force the lever sections 62*b* to turn in the direction of arrow w against the resiliency thereof. As the lever sections 62*b* are forced to turn in the direction of arrow w, they come to be located below the sliding routes of the second through fifth shutters 33Y, 33M, 33C and 33K. Then, the lever sections 62*b* unlock respectively the second through fifth shutters 33Y, 33M, 33C and 33K to allow them to slide and move.

Now, the operation of the above embodiment will be described below. When an image forming process is started, the waste toner box 30 is already mounted in the color copying machine 1 and the front cover 1*a* is closed. Therefore, the first through fifth shutters 33B, 33Y, 33M, 33C and 33K are pressed by the stay 1*b* of the front cover 1*a* against the resiliency of the respective springs 52 and 58*a* to open the conveyance end section 32*d* of the conveyance section 32 and the conveyance end sections 57*b* of the drum-side conveyance sections 57. In other words, the conveyance end section 32*d* and the conveyance end sections 57*b* are respectively through into the first through fifth collecting ports 31B, 31Y, 31M, 31C and 31K of the waste toner box 30 so that the waste toner box 30 can collect the waste toners removed by the belt cleaner 10*a* and the photosensitive member cleaning apparatus 16Y, 16M, 16C and 16K.

As an image forming process is started in this condition, video information is input from the scanner or the terminal of a personal computer and the photosensitive drums 12Y, 12M, 12C and 12K are driven to rotate to sequentially perform image forming operations in the image forming units 11Y, 11M, 11C and 11K. For instance, the surface of the photosensitive drum 12Y is uniformly charged with electricity by the electric charger 13Y in the yellow (Y) image forming unit 11Y.

Subsequently, a laser beam that corresponds to the input yellow (Y) video information is irradiated onto the photosensitive drum 12Y at the exposure position 17Y to form an electrostatic latent image. Then, a toner image is formed on the photosensitive drum 12Y by the development apparatus 18Y. Thereafter, the photosensitive drum 12Y contacts the intermediate transfer belt 10 that is driven to rotate in the direction of arrow s in FIG. 2 so that the toner image is transferred onto the intermediate transfer belt 10 by means of the primary transfer roller 18Y in a primary transfer operation.

A toner image forming process similar to the above-described yellow (Y) toner image forming process is executed for each of the remaining colors including magenta (M), cyan (C) and black (K). The toner images formed on the photosensitive drums 12M, 12C and 12K are sequentially laid on the intermediate transfer belt 10 as that where the yellow (Y) toner image is formed. Thus, a full color toner image is formed on the intermediate transfer belt 10 as a result of the multi-transfer operation for yellow (Y), magenta (M), cyan (C) and black (K).

Thereafter, the full color toner image formed on the intermediate transfer belt 10 by laying the monochromatic toner images gets to the position of the secondary transfer roller 27 and transferred onto a sheet of paper P at a time due to the transfer bias voltage of the secondary transfer roller 27 in a secondary transfer operation. Then, the sheet of paper P is subjected to a fixing process to finish the toner image. If an image is to be formed only on one of the surfaces of the sheet of paper P, the sheet of paper P is ejected to the inter-body sheet eject section 3 after the fixing process. If an image is to be formed on both of the surfaces of the sheet of paper P or a multiplex printing is to be performed, the sheet of paper P is fed once again to the position of the secondary transfer roller 27 by means of a re-conveyance unit (not shown).

Meanwhile, after the secondary transfer operation, the intermediate transfer belt 10 is cleaned by the belt cleaner 10*a* to remove the residual toner. Similarly, after the toner images on the photosensitive drums 12Y, 12M, 12C and 12K are transferred onto the intermediate transfer belt 10 in the primary transfer operation, the photosensitive drums are cleaned respectively by the photosensitive member cleaning apparatus 16Y, 16M, 16C and 16K to remove the residual toners to become ready for the next image forming process.

The waste toner including the residual toners collected respectively by the belt cleaner 10*a* and the photosensitive member cleaning apparatus 16Y, 16M, 16C and 16K are caused to flow into the waste toner box 30 respectively by the conveyance section 32 and the drum-side conveyance sections 57 by way of the first through fifth collecting ports 31B, 31Y, 31M, 31C and 31K.

As waste toner is made to flow into the waste toner box 30 and the photo-sensor 38 senses that the waste toner box 30 is full, the color copying machine 1 displays a message on a display panel (not shown) or the like, telling that the waste toner box 30 is full. When the message is displayed to tell that the waste toner box 30 is full, an operator is required to replace the waste toner box 30.

The operator firstly opens the front cover 1*a* and moves the stay 1*b* that has been pressing the first through fifth shutters 33B, 33Y, 33M, 33C and 33K away from the front end 53 of the first through fifth shutters 33B, 33Y, 33M, 33C and 33K. Then, as a result, the first through fifth shutters 33B, 33Y, 33M, 33C and 33K slide toward the front side due to the thrust forces of the respective springs 52, 58*a*. More specifically, the first shutter 33B slides in the direction of arrow t in FIG. 6, while the second through fifth shutters 33Y, 33M, 33C and 33K slide in the direction of arrow x in FIG. 13. Thus, the first through fifth shutters 33B, 33Y, 33M, 33C and 33K respectively close the conveyance end sections 32*d*, 57*b* as the shield sections 133*b* slide and move along the front surfaces of the conveyance end sections 32*d*, 57*b* of the conveyance section 32 and the drum-side conveyance sections 57.

In this condition where the conveyance end sections 32*d*, 57*b* are closed to prevent waste toner from spilling, the used waste toner box 30 is taken out to the front side. Then, as a result, the first through fifth projections 56B, 56Y, 56M, 56C and 56K are moved away respectively from the belt-side stopper 54 and the second through fifth drum-side stoppers 62. Thus, the belt-side stopper 54 and the second through fifth drum-side stoppers 62 are held to a locked condition. More specifically, the belt-side stopper 54 turns in the opposite to the direction indicated by arrow u due to its own weight and blocks the sliding route of the shutter 33B as shown in FIG. 10. As for the second through fifth drum-side stoppers 62, the lever sections 62*b* are forced to turn in the opposite to the direction indicated by arrow w by the resiliency of the leaf spring sections 62*a* so that the stoppers 62 block the respective sliding routes of the second through fifth shutters 33Y, 33M, 33C and 33K as shown in FIG. 15.

Thus, if the operator tries to close the front cover 1*a* without mounting a new waste toner box 30, the belt-side stopper 54 and the second through fifth drum-side stoppers 62 are locked and interfere with the stay 1*b* to prevent the operator from closing the front cover 1*a*.

Figure 11:
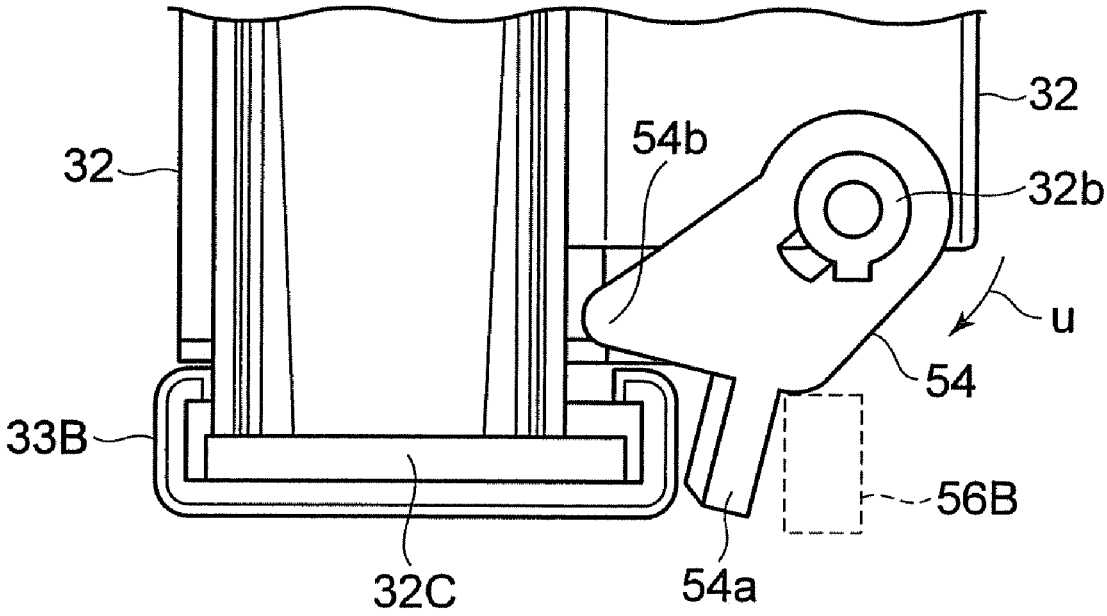
FIG. 11 is a schematic lateral view of the belt-side stopper according to the embodiment of the present invention in the unlocked state as viewed from the rear side of the conveyance section.

However, as the operator mounts a new waste toner box 30 in the frame 60 and pushes it away until it gets to the rear frame 60*a*, the first through fifth projections 56B, 56Y, 56M, 56C and 56K at the rear side of the waste toner box 30 respectively unlock the belt-side stopper 54 and the second through fifth drum-side stoppers 62. More specifically, the first projection 56B contacts the cam 54*a* of the belt-side stopper 54 as shown in FIG. 11. Then, as a result, the first projection 56B turns the belt-side stopper 54 in the direction of arrow u in FIG. 11 to open the sliding route of the shutter 33B. On the other hand, the second through fifth projections 56Y, 56M, 56C and 56K respectively contact the leaf spring sections 62*a* of the drum-side stoppers 62 as shown in FIG. 16. Then, as a result, the second through fifth projections 56Y, 56M, 56C and 56K respectively push up the leaf spring sections 62*a* of the drum-side stoppers 62 to consequently turn the lever sections 62*b* in the direction of arrow w in FIG. 16. Thus, the lever sections 62*b* open the sliding routes of the second through fifth shutters 33Y, 33M, 33C and 33K.

Therefore, as the operator closes the front cover 1*a* subsequently, the stay 1*b* presses the front end sections 53 of the first through fifth shutters 33B, 33Y, 33M, 33C and 33K so that the first through fifth shutters 33B, 33Y, 33M, 33C and 33K slide toward the rear side against the resiliency of the springs 52, 58*a*. More specifically, the first shutter 33B is forced to slide in the direction of arrow y so that the window section 133*a* is located in front of the conveyance end section 32*d* of the conveyance section 32 to hold the conveyance end section 32*d* open. Similarly, the second through fifth shutters 33Y, 33M, 33C and 33K are forced to side in the direction of arrow z so that the window sections 133*a* are located respectively in front of the conveyance end sections 57*b* to hold the latter open. As a result, waste toner can flow into the new waste toner box 30.

Thus, with the above-described embodiment, it is possible to close the first through fifth shutters 33B, 33Y, 33M, 33C and 33K respectively by means of the conveyance end sections 32*d*, 57*b* of the conveyance section 32 and the drum-side conveyance sections 57 by opening the front cover 1*a* at the time of replacing the waste toner box 30. Therefore, the conveyance end sections 32*d*, 57*b* are completely closed respectively by the first through fifth shutters 33B, 33Y, 33M, 33C and 33K when the operator draws out the waste toner box 30 from the frame 60 for the purpose of replacing it with a new one. Then, as a result, it is possible to reliably prevent waste toner of any of the conveyance section 32 and the drum-side conveyance sections 57 from spilling when the operator draws out the waste toner box 30 from the color copying machine 1.

Additionally, the first through fifth shutters 33B, 33Y, 33M, 33C and 33K are respectively locked by the belt-side stopper 54 and the drum-side stoppers 62 and prevented from sliding in the direction for bringing the conveyance end sections 32*d*, 57*b* into an open state as a result of drawing out the waste toner box 30 from the frame 60. Subsequently, when a new waste toner box 30 is mounted in the frame 60, the first through fifth shutters 33B, 33Y, 33M, 33C and 33K are unlocked because the locked state thereof brought forth respectively by the belt-side stopper 54 and the drum-side stoppers 62 is undone.

In other words, the stay 1*b* of the front cover 1*a* cannot press the first through fifth shutters 33B, 33Y, 33M, 33C and 33K unless a new waste toner box 30 is mounted in the frame 60 to unlock the belt-side stopper 54 and the drum-side stoppers 62. Thus, the stay 1*b* and the first through fifth shutters 33B, 33Y, 33M, 33C and 33K interfere with each other to make it impossible to close the front cover 1*a* unless a new waste toner box 30 is mounted in the frame 60. Accordingly, it is impossible for the first through fifth shutters 33B, 33Y, 33M, 33C and 33K to respectively bring the conveyance end sections 32*d*, 57*b* of the conveyance section 32 and the drum-side conveyance sections 57 into an open state.

Thus, at the time of replacing the waste toner box 30, in case a new waste toner box 30 is failed to be mounted and the front cover is closed, it is possible to reliably prevent an operation error from taking place for operating the color copying machine 1 without mounting a new waste toner box 30. Additionally, the ease of maintenance the color copying machine 1 at the time of replacing the waste toner box 30 is improved and the inside of the main body of the color copying machine is prevented from being stained by waste toner.

The present invention is by no means limited to the above-described embodiment, whose design may be modified and altered in various different ways without departing from the scope of the present invention. For example, no limitations are imposed on the configuration and the structure of the conveyance sections. Similarly, the shutters are free from limitations in terms of configuration and mode of supporting so long as they are interlocked with the cover for the operation of opening and closing the conveyance end sections of the conveyance sections. The structure of the image forming apparatus is also free from limitations. For example, the image forming apparatus may be a monochromatic image forming apparatus having a shutter interlocked with the cover for the operation of opening and closing the single conveyance end section.

Additionally, the lock members for blocking the sliding routes of the shutters are not subjected to any limitations in terms of structure, position for arrangement and number so long as they are adapted to prevent the shutters from being brought into an open state without a waste toner containing member mounted in the image forming apparatus main body. For example, the third and fourth drum-side stoppers 62 may be omitted from the above-described embodiment, leaving only the belt-side stopper 54 and the second and fifth drum-side stoppers 62 as a lock member in place. Such an arrangement can reduce the cost because of the reduced number of lock members.

What is claimed is:

1. A waste toner collecting apparatus, comprising:

a waste toner containing member to be replaceable mounted in a main body of an image forming apparatus and through into a conveyance section for conveying waste toner collected from an image forming section in order to contain the waste toner;

a shutter adapted to slide in a motion interlocked with an opening/closing motion of a cover of the main body of the image forming apparatus in order to open a conveyance end section of the conveyance section at the time of closing the cover but close the conveyance end section of the conveyance section at the time of opening the cover; and a lock member adapted to contact the waste toner containing member mounted in the main body of the image forming apparatus in order to open a moving route of the shutter at the time of sliding the shutter to open it but move away from the waste toner containing member in order to block the moving route of the shutter at the time of sliding the shutter to open it.

2. The waste toner collecting apparatus according to claim 1, wherein a plurality of conveyance sections are provided for the waste toner collected from the image forming section and the waste toner containing member is through into the plurality of conveyance sections, and a plurality of shutters being provided to correspond to the conveyance sections.

3. The waste toner collecting apparatus according to claim 2, wherein the plurality of conveyance sections include a conveyance section for the waste toner collected from the intermediate transfer medium of the image forming section and a plurality of conveyance sections arranged substantially linearly for the waste toners collected from a plurality of image carriers of the image forming section.

4. The waste toner collecting apparatus according to claim 3, wherein the waste toner containing member further includes an unlocking member adapted to contact and turn the lock member.

5. The waste toner collecting apparatus according to claim 4, wherein the plurality of lock members are provided to correspond to all of the waste toner conveyance sections and the same number of unlocking members are provided to correspond to the plurality of lock members.

6. The waste toner collecting apparatus according to claim 4, wherein the apparatus comprises at least a lock member that corresponds to the conveyance section for the waste toner collected from the intermediate transfer medium and lock members that correspond respectively to the both ends of the plurality of conveyance sections for the waste toners collected from the plurality of image carriers and a plurality of unlocking member are provided to correspond respectively to the plurality of lock members.

7. The waste toner collecting apparatus according to claim 2, wherein the plurality of shutters are provided respectively with resilient members that apply force to them in the direction of the conveyance end sections into a closed state.

8. The waste toner collecting apparatus according to claim 7, wherein the plurality of shutters contact a single stay arranged on the cover to bring the conveyance end sections into an open state against the resiliency of the resilient members when the cover is closed.

9. An image forming apparatus, comprising:

an image forming section formed by arranging a plurality of image forming units along an intermediate transfer medium, the image forming units having toner image forming means arranged around an image carrier;

a plurality of conveyance sections for conveying waste toners collected from the plurality of image forming units and the intermediate transfer medium in predetermined directions;

a waste toner containing member to be replaceable mounted in a main body of the image forming apparatus and held in communication with the plurality of conveyance sections in order to contain the waste toner;

a plurality of shutters adapted to slide in a motion interlocked with an opening/closing motion of a cover of the main body of the image forming apparatus in order to open the conveyance end sections of the conveyance sections at the time of closing the cover but close the conveyance end sections of the conveyance sections at the time of opening the cover; and a plurality of lock members adapted to contact the waste toner containing member mounted in the main body of the image forming apparatus in order to respectively open the moving routes of the shutters at the time of sliding the shutters to open them but move away from the waste toner containing member in order to block the moving route of the shutters at the time of sliding the shutters to open them.

10. The image forming apparatus according to claim 9, wherein a plurality of lock members are provided to correspond to all of the waste toner conveyance sections.

11. The image forming apparatus according to claim 9, wherein at least a lock member that corresponds to the conveyance section for the waste toner collected from the intermediate transfer medium and lock members that correspond respectively to the both ends of the plurality of conveyance sections for the waste toners collected from the plurality of image carriers are provided.

12. The image forming apparatus according to claim 9, wherein the plurality of shutters are provided respectively with resilient members that apply force to them in the direction of the conveyance end sections into a closed state.

13. The image forming apparatus according to claim 12, wherein the cover is provided with a single stay adapted to contact the plurality of shutters at the time of closing the cover and the shutters are provided respectively with resilient members that apply force to them in the direction of brining the conveyance end sections into an open state when the stay contacts the shutters.

14. A process cartridge of an image forming apparatus formed integrally with an image carrier and a cleaning member for cleaning the image carrier and adapted to be integrally and removably fitted to the main body of the image forming apparatus, the cartridge comprising:

a conveyance section for conveying a waste toner collected from the image carrier from the cleaning member toward a waste toner containing member;

the conveyance section through into the waste toner containing member by way of a shutter:

the shutter being adapted to slide in a motion interlocked with the opening/closing motion of a cover of the main body of the image forming apparatus in order to open the conveyance end section of the conveyance section at the time of closing the cover but close the conveyance end section of the conveyance section at the time of opening the cover, and the shutter become blocked against sliding in the direction of opening itself by a lock member adapted to contact the waste toner containing member mounted in the main body of the image forming apparatus in order to open the moving route of the shutter at the time of sliding the shutter to open it, but move away from the waste toner containing member in order to close the moving route of the shutter at the time of sliding the shutter to open it.

* * * * *